US006523712B1

(12) United States Patent
McGushion

(10) Patent No.: US 6,523,712 B1
(45) Date of Patent: Feb. 25, 2003

(54) FLUID DISCHARGE REDUCING BEVERAGE CLOSURE

(76) Inventor: Aaron Paul McGushion, 127 6th St. #4, Seal Beach, CA (US) 90740

( * ) Notice: Subject to any disclaimer, the term of this patent is extended or adjusted under 35 U.S.C. 154(b) by 180 days.

(21) Appl. No.: 09/667,941

(22) Filed: Sep. 22, 2000

Related U.S. Application Data

(60) Provisional application No. 60/155,356, filed on Sep. 22, 1999.

(51) Int. Cl.[7] ..... A47G 19/22
(52) U.S. Cl. ..... 220/713
(58) Field of Search ..... 220/713, 711, 220/714; D7/511, 534, 900

(56) References Cited

U.S. PATENT DOCUMENTS 2,414,697 A * 1/1947 Pettersson ..... 138/44
4,503,992 A * 3/1985 Sitko et al. ..... 220/713
4,619,372 A * 10/1986 McFarland ..... 220/713
4,767,019 A * 8/1988 Horner ..... 220/713
4,811,860 A * 3/1989 Sorenson et al. ..... 206/508
4,828,141 A * 5/1989 Coy ..... 220/380
4,946,062 A * 8/1990 Coy ..... 215/11.4
5,381,924 A * 1/1995 Kiefel ..... 215/229
5,509,568 A * 4/1996 Warden et al. ..... 220/254.1
5,538,157 A * 7/1996 Proshan ..... 220/711
6,230,924 B1 * 5/2001 Weiss et al. ..... 220/366.1
6,305,571 B1 * 10/2001 Chu ..... 215/387

* cited by examiner

*Primary Examiner*—Jes F. Pascua

(57) ABSTRACT

A lid is provided which is configured to facilitate fluid consumption from a container through an aperture in the lid without spillage. The preferred lid includes a mounting portion for gripping the upper rim of the container, a sidewall extending upwardly from the mounting portion, and a top wall having a fluid consumption aperture formed therethrough. A spout descends from the fluid consumption aperture towards the interior of the container to which the lid is mounted. The fluid contained within the container must travel through the spout before exiting the fluid consumption aperture. The geometry of the spout is generally either tubular or hollow frusta-conical. One or more steam venting apertures may be formed through the top wall.

9 Claims, 2 Drawing Sheets

FLUID DISCHARGE REDUCING BEVERAGE CLOSURE

CROSS-REFERENCE TO RELATED APPLICATIONS

This application is entitled to the benefit of Provisional Patent Application Ser. No. 60/155,356, filed on Sep. 22, 1999.

BACKGROUND—FIELD OF INVENTION

This invention relates generally to a lid enabling fluid consumption from a fluid container without removal of the lid and more particularly to a spill-resistant lid for use in combination with a drinking cup.

BACKGROUND—DESCRIPTION OF PRIOR ART

Coffee shops and other vendors who sell beverages "to go" commonly apply disposable lids to disposable drinking containers. Such lids help to keep the cup's contents from spilling. Many of the disposable lids on the market are either of the drink through variety or must be removed before consumption of the beverage.

Originally, the lid had to be removed by the consumer before gaining access to the beverage. Removal of the lid is inconvenient, particularly if the user attempts to hold the cup and remove the lid with one hand. Also, if the user desires to drink the beverage while walking or traveling in a vehicle, removal of the lid may enable the beverage to splash out of the cup should the cup be jarred, or pour out of the cup should the cup be tilted.

Thereafter, inventors created several types of lids designed to allow the user to consume the beverage without removal of the lid. U.S. Pat. No. 4,953,743 to Dart and Darras (1990) discloses a lid which has score lines formed in it to define a removable portion which may punched out and folded to provide access to the beverage. One disadvantage of this type of lid is that it may be inconvenient for the user to perform the requisite penetration or folding of the lid, particularly if the user is walking or riding in a vehicle, or otherwise has only one hand free. Another disadvantage of this type of lid is that the large hole formed in the lid from the removal of the punched out section generally allows the beverage to easily splash out of the container if it is jarred or tilted. Additionally, a small amount of remnant fluid remaining in the container after the consumer has finished using the product may easily spill out when the container is discarded on a vehicle seat or floor.

U.S. Pat. No. 4,589,569 to Clements (1986) shows a drink-through lid with a preformed opening for drinking which is elevated above the rim of the beverage container. Even though this design prevents some of the spillage due to tilting and jarring, it still allows the beverage to splash on the consumer or the consumer's clothing, car, and other property. Hot liquid splashing out of the container can be an inconvenience as well as a safety hazard, causing burns and distractions.

Many other disposable beverage lids are of a complicated design, expensive to manufacture, and impractical to use. U.S. Pat. No. 4,899,902 to DeMars (1990) provides a beverage lid with a drink-through hole cover. Although this design results in a splash-proof seal, the disadvantage is that the cover must be manipulated with the thumb to open and close the drink-through hole. This manually-operated design is inconvenient and bothersome to use because every time the user desires a drink of the beverage, the cover must be opened and then closed afterwards.

What is needed is a lid that prevents unwanted fluid discharge resulting from jarring and tilting. What is also needed is a lid that allows the user to consume the beverage without manually opening and closing lids or valves.

SUMMARY OF THE INVENTION

In accordance with the present invention, a lid is provided which is configured to facilitate fluid consumption from a container through an aperture in the lid without spillage. The preferred lid includes a mounting portion for gripping the upper rim of the container, a sidewall extending upwardly from the mounting portion, and a top wall having a fluid consumption aperture formed therethrough. A spout descends from the fluid consumption aperture towards the interior of the container to which the lid is mounted. The fluid contained within the container must travel through the spout before exiting the fluid consumption aperture. The geometry of the spout is generally either tubular or hollow frusta-conical. One or more steam venting apertures may be formed through the top wall.

In another embodiment, a plurality of generally hollow frusta-conical spouts descend from the fluid consumption aperture towards the interior of the container to which the lid is mounted. These individual spouts are positioned so that mouth of the consumer can easily receive fluid from the container during consumption. Again, one or more steam venting apertures may be formed through the top wall.

Although the proceeding theory of operation is believed to be true, the inventor does not wish to be bound by this. When a fluid, such as coffee, is contained within a cup, with a standard lid mounted on the cup, is disturbed by a jarring movement, the fluid tends to splash within the container. This splashing action causes the fluid to rise up towards the lid, near the perimeter of the lid. The fluid may impact the inner surface of the lid, its momentum forcing a portion of the fluid through and out of the drink-through aperture. A portion of the fluid not immediately near the drink-through aperture may impact the inner surface of the lid, spread out over the inner surface, and ultimately be reflected back into the container.

The present invention addresses this fluid splash problem by introducing a splash dissipating spout at the drink-though aperture location on a standard lid configuration. This splash dissipating spout places the fluid exit aperture well below the inner surface of the lid and the point of fluid momentum change. When the agitated fluid strikes the inner surface of the lid, it is allowed to spread out and dissipate on the inner surface, instead of being forced out of the drink-through aperture. When the spout has a hollow frusta-conical geometry, an approaching fluid wave is allowed to pass by the fluid exit aperture with little hindrance. Therefore, much of the fluid is retained within the container until a person wishes to consume the beverage. Acting much like a straw during consumption, the fluid easily flows out of the container. Additionally, the spout design helps to prevent remnant fluid from exiting the container when it has been discarded on a vehicle seat or floor.

This lid can be manufactured using known molding procedures. The preferred method of manufacture would be vacuum molding. A punch and die may be used to form the apertures.

OBJECTS OF THE INVENTION

It is an object of the present invention to provide a lid for a container holding a liquid.

It is yet another object of the present invention to provide a lid which has means integrally associated in the lid for consuming fluid therefrom.

It is another object of the present invention to provide a lid with a means for substantially preventing fluid from splashing out of the integrally associated fluid consumption means.

It is a still further object of the present invention to provide a means for consuming the beverage held within the container without the manipulation of any valves, covers, or other means commonly utilized to seal beverage lids.

These and further objects and advantages of the present invention will become apparent upon consideration of the following commentary taken in conjunction with the drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
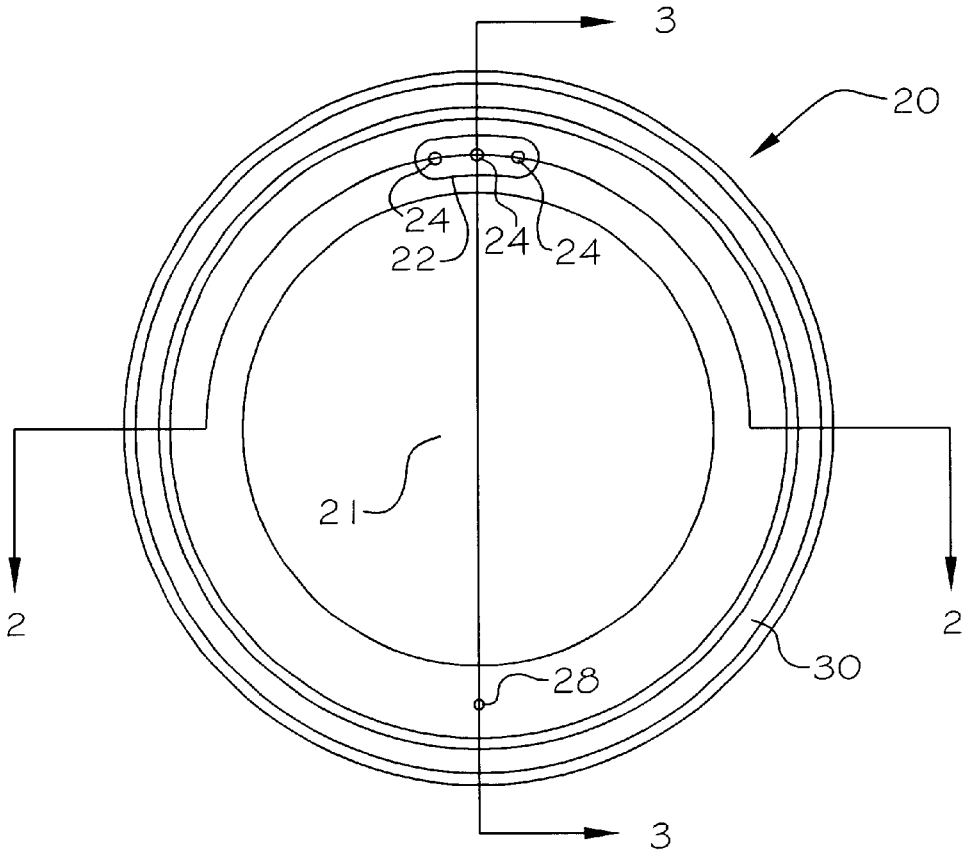
FIG. 1 is a top plan view of the present invention of the splash-dissipating fluid lid of the present invention.

In FIG. 1, an overhead view of the lid 20 according to the present invention is shown. The fluid consumption aperture 22 is generally situated near the outer edge of the top wall 21. Generally, on the opposing quadrant of the top wall 21 is a vent aperture 28. The vent aperture, however, may be placed elsewhere on the top wall 21.

Figure 2:
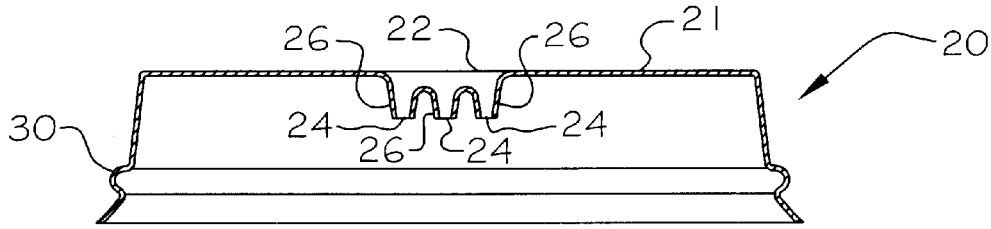
FIG. 2 is a side cross-sectional view of the lid of the present invention shown in FIG. 1 taken along line 2—2.

Referring particularly to FIG. 2, a plurality of spouts 26 descend from the top wall 21 immediately beneath the fluid consumption aperture 22. In the preferred embodiment, the geometry of the spout is generally hollow frusta-conical. The fluid inlet aperture 24 of the preferred embodiment is generally smaller in size that the fluid consumption aperture 22.

Figure 3:
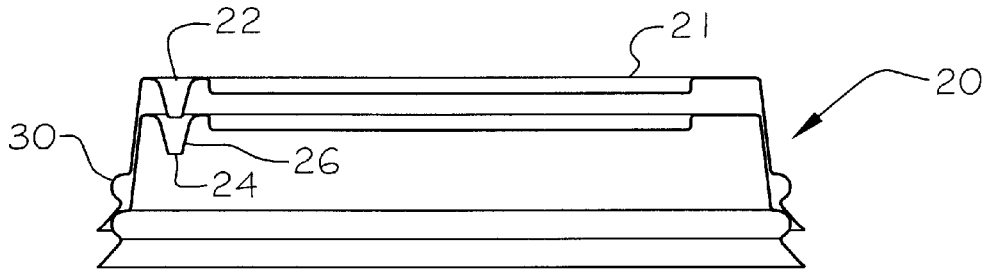
FIG. 3 is a side cross-sectional view of a pair of lids of the present invention taken along line 3—3, when stacked upon one another.

In FIG. 3, two lids 20 are shown in the nested or stacked configuration. It can be seen that the spouts 26 in no way interfere with the compact stacking of lids 20 when being shipped or stored. This also demonstrates that the lid 20 of the present invention stacks as compactly as lids currently being sold.

Figure 4:
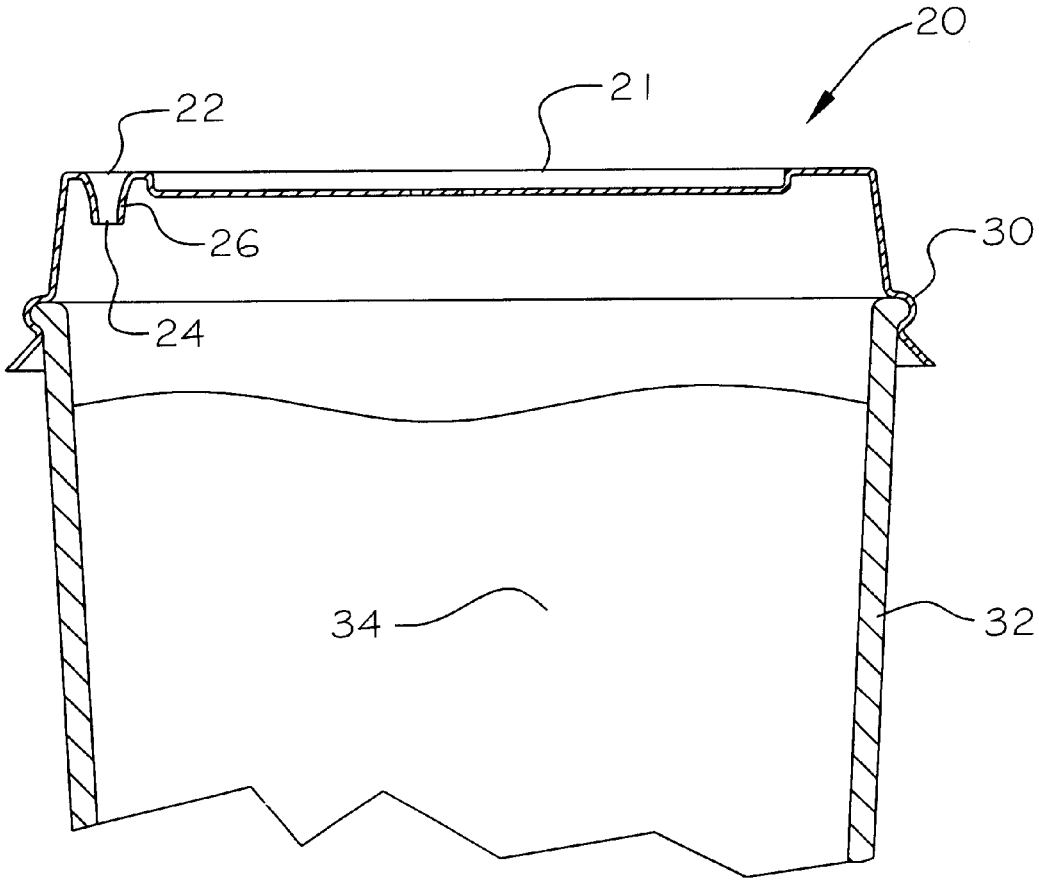
FIG. 4 is a side elevational and cutaway view of the splash-dissipating fluid lid of the present invention shown attached to a cup.

In FIG. 4, the lid 20 is attached to a container 32. The lid 20 engages the container 32 with a container engaging means 30. The fluid 34 contained within the container 32 must travel through one or more of the spouts 26 before exiting through the fluid consumption aperture 22.

Figure 5:
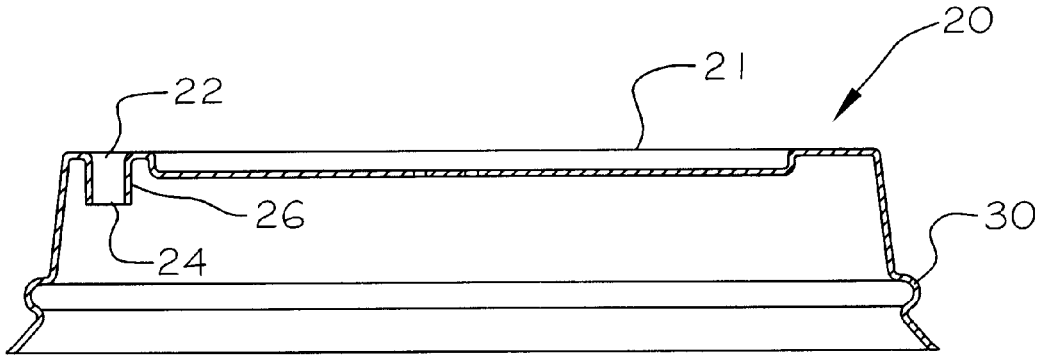
FIG. 5 is a side cross-sectional view of an alternative embodiment of the splash-dissipating beverage lid of the present invention, having an alternate spout configuration.

In FIG. 5, an alternate embodiment of the present invention can be seen. The spout 26 generally has a tubular geometry with a generally constant tube diameter.

The advantages of these designs are simplicity and effectiveness. Without any moving parts or valves, the inventive lid 20 substantially reduces beverage splash. The consumer does not have to pull any tabs, open any valves, or operate any kind of device to consume the fluid 34. Another important advantage is that the lid 20 prevents burns caused by a hot beverage. In addition, the consumer will be more inclined to buy hot beverages "to go" if it is realized that the beverage can be transported easily and safely, without fear of spilling it on the clothing, car, or hand. All of these advantages combine to make one of the most practical and effective disposable beverage lids to date.

While the present invention has been described with regards to particular embodiments, it is recognized that additional variations of the present invention may be devised without departing from the inventive concept.

Having thus described the invention, it is now claimed:

1. A dispensing lid for a beverage container, comprising:

a) a mounting portion for gripping an upper rim of said beverage container;

b) a transverse wall extending across said mounting portion, with a bottom surface facing said upper rim of said beverage container;

c) a consumption aperture located through said transverse wall, located substantially near the outer perimeter of said transverse wall;

d) a plurality of tubular walls extending downwardly and substantially perpendicular to said bottom surface of said transverse wall, with said tubular walls defining a downward extension of said consumption aperture, a lowermost end of said tubular walls, wherein an aperture is formed through each of said tubular walls at said lowermost end, for receiving a beverage into said tubular walls from said beverage container.

2. The dispensing lid of claim 1 wherein said tubular walls have a substantially hollow frustum geometry, with said lowermost end being least in cross-sectional diameter.

3. The dispensing lid of claim 2 wherein said tubular walls are extending downward approximately 0.2".

4. The dispensing lid of claim 2 wherein said tubular walls are extending downward less than approximately 0.35".

5. The dispensing lid of claim 1 wherein said tubular walls are extending downward approximately 0.2".

6. The dispensing lid of claim 1 wherein said tubular walls are extending downward less than approximately 0.35".

7. The dispensing lid of claim 1 wherein a plenum is formed between said consumption aperture and said tubular walls communicating said beverage from said tubular walls to said consumption aperture; wherein said plenum is substantially hollow oblong hemispherical.

8. The dispensing lid of claim 1 wherein said consumption aperture is substantially elliptical.

9. The dispensing lid of claim 8 wherein a center axis is formed through each of said tubular walls, and said center axes of each said tubular walls are substantially in line and substantially parallel one to another, extending downwardly and substantially perpendicular to said bottom surface; said aperture being formed substantially normal to said center axis.

* * * * *